US007828644B2

(12) United States Patent
Okada

(10) Patent No.: US 7,828,644 B2
(45) Date of Patent: Nov. 9, 2010

(54) SLOT MACHINE WITH RANDOMLY SELECTED SCATTER SYMBOL

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 736 days.

(21) Appl. No.: 11/790,458

(22) Filed: Apr. 25, 2007

(65) Prior Publication Data

US 2008/0090638 A1 Apr. 17, 2008

Related U.S. Application Data

(60) Provisional application No. 60/852,018, filed on Oct. 17, 2006.

(51) Int. Cl.
*A63F 9/24* (2006.01)

(52) U.S. Cl. ..... 463/21; 463/16; 463/20; 463/31

(58) Field of Classification Search ..... 463/16, 463/20, 31

See application file for complete search history.

(56) References Cited

U.S. PATENT DOCUMENTS

| | | | | |
|---|---|---|---|---|
| 6,604,999 | B2 | 8/2003 | Ainsworth | |
| 2002/0065124 | A1 | 5/2002 | Ainsworth | |
| 2002/0198039 | A1 * | 12/2002 | Marks et al. | 463/20 |
| 2004/0053676 | A1 * | 3/2004 | Rodgers | 463/20 |
| 2004/0242314 | A1 * | 12/2004 | Casey | 463/20 |

* cited by examiner

*Primary Examiner*—James S McClellan
*Assistant Examiner*—Lawrence Galka
(74) *Attorney, Agent, or Firm*—NDQ&M Watchstone LLP

(57) ABSTRACT

A scatter object symbol is randomly selected among plural symbols. The symbols are rearranged. A payout determined by a combination of the symbols rearranged on a payline is awarded. When a predetermined number or more of the scatter object symbols are rearranged, the scatter object symbol is set as a scatter symbol. It is notified contents of a payout determined on the basis of the scatter symbol and the corresponding payout is awarded.

15 Claims, 16 Drawing Sheets

FIG. 6

| | reel14A | reel14B | reel14C | reel14D | reel14E |
|---|---|---|---|---|---|
| code No. | symbol | symbol | symbol | symbol | symbol |
| 00 | JACKPOT7 | JACKPOT7 | JACKPOT7 | JACKPOT7 | JACKPOT7 |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE7 |
| 06 | ORANGE | PLUM | ORANGE | APPLE | ORANGE |
| 07 | PLUM | CHERRY | PLUM | BLUE7 | APPLE |
| 08 | BLUE7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE7 | STRAWBERRY | CHERRY | ORANGE |
| 14 | BLUE7 | BELL | BLUE7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE7 | BELL | ORANGE | CHERRY | PLUM |
| 21 | CHERRY | APPLE | PLUM | PLUM | STRAWBERRY |

FIG. 9 scatter object symbol-determining table

| symbol | range of random numbers |
|---|---|
| BELL | 0~50 |
| CHERRY | 51~100 |
| ORANGE | 101~150 |
| STRAWBERRY | 151~200 |
| PLUM | 201~255 |

FIG. 10 set threshold value-determining table

| set threshold value | range of random numbers |
|---|---|
| 2 | 0~50 |
| 3 | 51~100 |
| 4 | 101~150 |
| 5 | 151~200 |
| 6 | 201~255 |

FIG. 11 notification content table

| symbol | character | payout-number | first description | second description |
|---|---|---|---|---|
| BELL | 1 | 1 | "symbol has become a scatter symbol" | "coin is "–" pieces because there are the "symbols" of the "rearrangement number." |
| CHERRY | 1 | 5 | | |
| ORANGE | 1 | 2 | | |
| STRAWBERRY | 2 | 3 | | |
| PLUM | 2 | 4 | | |

SLOT MACHINE WITH RANDOMLY SELECTED SCATTER SYMBOL

CROSS REFERENCE TO RELATED APPLICATION

This application claims the benefit of U.S. Provisional Application No. 60/852,018, filed on Oct. 17, 2006.

BACKGROUND OF THE INVENTION

1. Field of the Invention

The invention relates to a slot machine and a playing method thereof.

2. Description of Related Art

In a conventional slot machine, when a player inserts a game medium such as coin or bill into an insertion slot of the slot machine and pushes a spin button, plural symbols are scroll-displayed in a display mounted on a front of a cabinet and the symbols are then stopped automatically.

In such slot machine, as disclosed in U.S. Pat. No. 6,604,999 B2 or U.S. Patent No. 2002065124A1, for example, when the symbols stopped on a payline constitute a predetermined combination, predetermined number of game media are paid out. In addition, when a certain symbol referred to as scatter symbol is displayed on the display, predetermined number of game media are paid out in accordance with the number of scatter symbols displayed, irrespective of the payline. In other words, in the conventional slot machine, the payout is made in combination with the two methods.

The invention provides a slot machine having an entertainment characteristic, which is not provided to the prior art, and a playing method thereof.

SUMMARY OF THE INVENTION

The invention provides a slot machine comprising a structure as described below and having a display and a game controller. The display has a payline and arranges plural symbols. The game controller randomly selects to determine a scatter object symbol among the symbols. In addition, the game controller rearranges the symbols and awards a payout determined by a combination of the symbols rearranged on the payline. When predetermined number or more of the scatter object symbols are rearranged, the game controller sets the scatter object symbol as a scatter symbol, and notifies contents of a payout determined on the basis of the scatter symbol and awards the corresponding payout.

In the slot machine of the invention, a scatter object symbol is randomly selected and determined among the plural symbols. The symbols including the scatter object symbol are rearranged. After that, when the rearrangement number of the scatter object symbol is a predetermined number or more, the scatter object symbol is set as a scatter symbol. Then, a payout is awarded on the basis of a combination of the symbols rearranged on the payline. In addition, contents of a payout determined on the basis of the scatter symbols rearranged on and out of the payline are notified and the corresponding payout is awarded.

The slot machine of the invention may further have a structure as described below. Specifically, when a scatter object symbol is set as a scatter symbol, the game controller of the slot machine may notify contents of a payout determined on the basis of a payout unit corresponding to a type of the scatter symbol. In addition, the game controller may provide a display area to a part different from an arrangement area for arranging the symbols and display the scatter object symbol in the display area. Furthermore, the game controller may change a display form of the scatter object symbol from after the scatter object symbol is determined until it is rearranged.

The invention provides a playing method of a slot machine having a structure as described below. Among plural symbols, a scatter object symbol is randomly selected and determined. The symbols are rearranged. A payout is awarded which is determined on the basis of a combination of the symbols rearranged on the payline. When predetermined number or more of the scatter object symbols are rearranged, the scatter object symbol is set as a scatter symbol. It is notified contents of a payout determined on the basis of the scatter symbol and the corresponding payout is awarded.

In the playing method of the slot machine of the invention, a scatter object symbol is randomly selected and determined among plural symbols. The symbols including the scatter object symbol are rearranged. After that, when the rearrangement number of the scatter object symbol is a predetermined number or more, the scatter object symbol is set as a scatter symbol. Then, a payout is awarded on the basis of a combination of the symbols rearranged on the payline. In addition, it is notified contents of a payout determined on the basis of the scatter symbols rearranged on and out of the payline and the corresponding payout is awarded.

The playing method of the invention may further have a structure as described below. Specifically, when a scatter object symbol is set as a scatter symbol, the slot machine may notify contents of a payout determined on the basis of a payout unit corresponding to a type of the scatter symbol. In addition, the slot machine may provide a display area to a part different from an arrangement area for arranging the symbols and display the scatter object symbol in the display area. Furthermore, the slot machine may change a display form of the scatter object symbol from after the scatter object symbol is determined until it is rearranged.

BRIEF DESCRIPTION OF THE DRAWINGS

FIG. 6 shows symbols and code numbers thereof;

FIG. 9 shows a scatter object symbol-determining table;

FIG. 10 shows a setting threshold value-determining table;

FIG. 11 shows a scatter symbol description table;

DESCRIPTION OF THE PREFERRED EMBODIMENTS

Embodiment 1

It will be described an embodiment 1 of a slot machine and a playing method thereof according to the invention.

Figure 1:
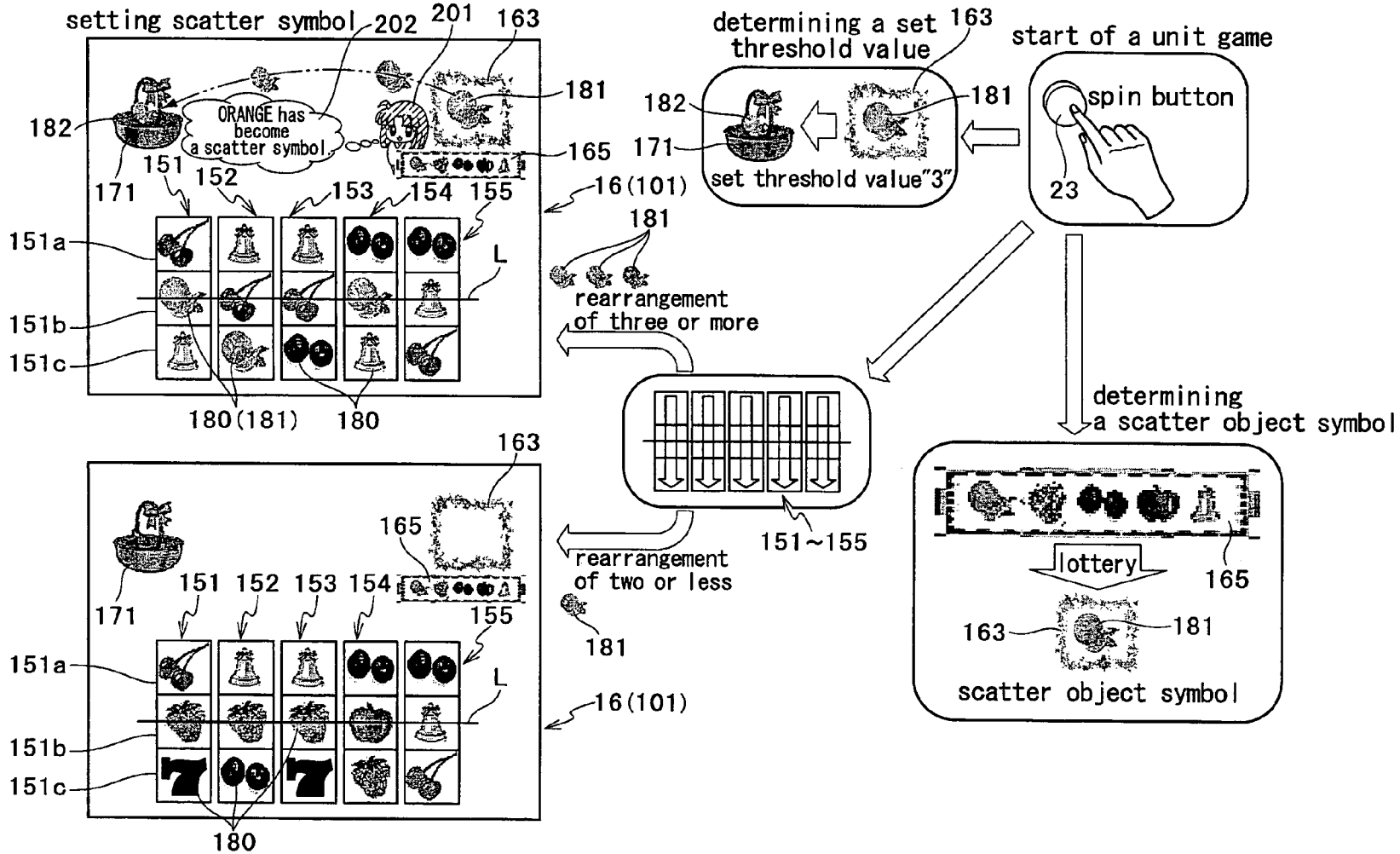
FIG. 1 illustrates a playing method of a slot machine.

As shown in FIG. 1, a slot machine executes a playing method comprising steps of randomly selecting to determine a scatter object symbol 181 among plural symbols 180, rearranging the symbols 180 in a display, awarding a payout determined on the basis of a combination of the symbols 180 rearranged on a payline L, and when predetermined number or more of scatter object symbols 181 are rearranged, setting the scatter object symbol 180 as a scatter symbol 182, notifying contents of a payout determined on the basis of the scatter symbol 182 and awarding the corresponding payout.

Further, the slot machine 10 executes a playing method comprising steps of providing a display area (scatter object symbol display unit 163) to a part different from an arrangement area (display windows 151~155) for arranging the symbols 180 and displaying the scatter object symbol 181 in the display area, and when the predetermined number of the scatter object symbols 181 are rearranged, notifying that the scatter object symbol 181 is set as the scatter symbol 182.

Herein, the "arrangement" means a state in which the symbols 180 including the scatter symbol 182 are allowed to be visible with naked eyes of an exterior player. In other words, in FIG. 1, the symbols 180 are under state of being displayed in the display windows 151~155. In the mean time, the "rearrangement" is meant by arranging the symbols 180 again after dismissing the arrangement of the symbols 180. In addition, the "payline" L is provided to determine a combination of the symbols 180. In other words, when the symbols 180 are rearranged on and out of the payline L, a combination is determined for only the symbols 180 rearranged on the payline. As a result of the determination for a combination, when it is made a winning combination, it is carried out, for example, a process of paying out a coin in accordance with the winning combination.

In addition, the "scatter symbol" 182 is a symbol making it a condition that a winning is made through only the arrangement thereof, irrespective of the payline L. In other words, when the scatter symbol 182 is rearranged, a winning is made and it is carried out, for example, a process of paying out a coin on the basis of the number of all the scatter symbols 182 rearranged on and out of the payline L. The "scatter object symbol 181" is a symbol serving as a scatter symbol on condition that the predetermined number of the symbols are rearranged. For example, in case that the scatter object symbol is "Bell" and "3" is set as a rearrangement number (set threshold value), when three or more "Bells" are rearranged, Bell serves as a scatter symbol, and when two or less "Bell" is rearranged, it serves as a normal symbol. Furthermore, the "symbol 180" is meant by all symbols used in the slot machine 10 and includes the scatter symbol 182 and the scatter object symbol 181. The payline L, the symbol 180, the scatter symbol 182 and a winning combination will be more specifically described later.

(Display Unit 101)

Figure 2:
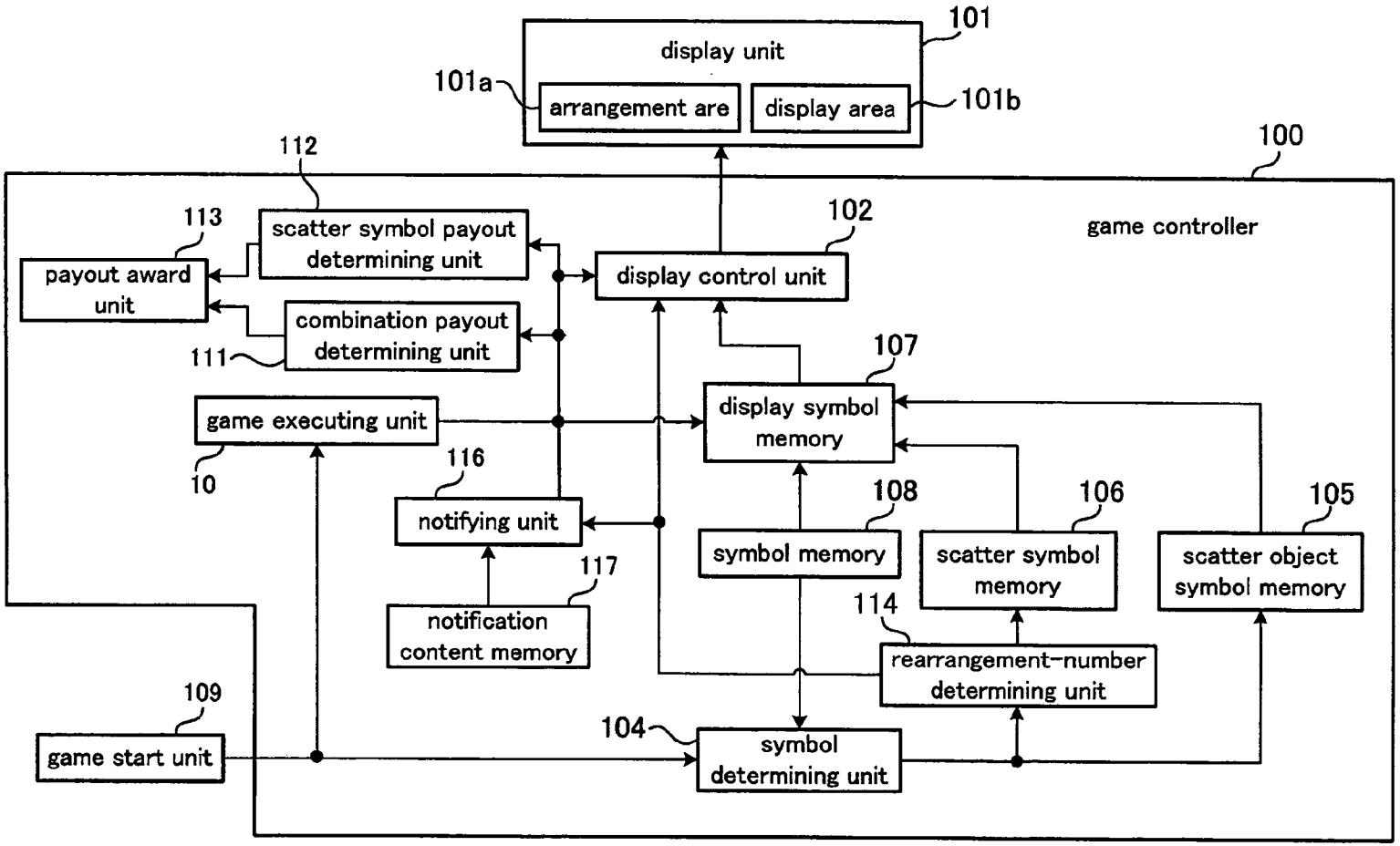
FIG. 2 is a block diagram of a slot machine.

As shown in FIG. 2, the slot machine executing the above playing method is provided with a display unit 101 (display) and a game controller 100. The display unit 101 is structured to have the payline L and to arrange the plural symbols including the scatter symbol 182. In addition, the display unit 101 is structured to provide a scatter object symbol display unit (display area 101*b*) to a part different from display windows 151~155 (arrangement area 101*a*) for arranging the symbols 180.

The display unit 101 may be a mechanical structure with a reel device for arranging the symbols 180 by rotation of a reel or electrical structure with a video reel on which an image is displayed for arranging the symbols 180. Further, the display unit 101 may be a structure of combining a mechanical structure (reel) and an electrical structure (video reel). The electrical structure may include a liquid crystal device, a CRT (cathode-ray tube), a plasma display and the like. A detailed structure of the display unit 101 will be described later.

(Game Controller 100)

The game controller 100 is adapted to execute a first process of randomly selecting to determine the scatter object symbol 181 among the plural symbols 180, a second process of rearranging the symbols 180 in the display, a third process of awarding a payout determined on the basis of a combination of the symbols 180 rearranged on the payline L and a fourth process of when the predetermined number or more of the scatter object symbols 181 are rearranged, setting the scatter object symbol 181 as the scatter symbol 182, notifying contents of a payout determined on the basis of the scatter symbol 182 and awarding the corresponding payout at the same time. In other words, the game controller 100 has a first processing unit, a second processing unit, a third processing unit and a fourth processing unit.

Further, the game controller 100 is also adapted to execute a fifth process of providing the display area 101*b* (scatter object symbol display unit 163) to a part different from the arrangement area 101*a* for arranging the symbols 180 and displaying the scatter object symbol 181 in the display area 101*b* and a sixth process of when the predetermined number or more of the scatter object symbols 181 are rearranged, notifying that the scatter object symbol 181 is set as the scatter symbol 182. In other words, the game controller 100 has a fifth processing unit and a sixth processing unit in addition to the first to fourth processing units.

The game controller 100 comprises a scatter object symbol memory 105 for storing the scatter object symbol 181, a scatter symbol memory 106 for storing the scatter symbol 182, a symbol memory 108 for storing all the symbols including the scatter symbol 182, and a display symbol memory 107 for storing the symbols in the respective memories 105, 106, 108 as a display symbol. The display symbol memory 107 can be accessed by a display control unit 102. The display control unit 102 sets the arrangement area 101*a* for arranging the plural symbols 180 and the display area 101*b* for displaying the scatter object symbol in the different parts of the display unit 101. In addition, the display control unit 102 reads out the symbols 180 in the display symbol memory 107 under control of a game executing unit 110 and displays the plural symbols 180 in the arrangement area 101*a* and the scatter object symbol 181 in the display area 101*b*. A detailed display state will be described later.

Further, the game controller 100 is connected to a game start unit 109. The game start unit 109 has a function of outputting a game start signal in accordance with an operation of the player. The game controller 100 comprises the game executing unit 110 for executing a unit game rearranging the symbols with an input of a game start signal, as trigger, from the game start unit 109, a combination payout determining unit 111 for determining a payout determined by a combination of the symbols rearranged on the payline in a unit game, a scatter symbol payout determining unit 112 for determining a payout determined on the basis of the scatter symbols rearranged on and out of the payline and a payout award unit 113 for awarding the respective payouts determined in the combination payout determining unit 111 and the scatter symbol payout determining unit 112.

Furthermore, the game controller 100 has a symbol determining unit 104 which is operated when a game start unit is inputted from the game start unit 109. The symbol determining unit 104 randomly selects to determine the scatter object symbol 181 among the plural symbols 180. The symbol determining unit 104 outputs the scatter object symbol 181 to a rearrangement-number determining unit 114 and the scatter object symbol memory 105. The rearrangement number determining unit 114 sets the scatter object symbol 181 as the scatter symbol 182, when predetermined number of the scatter object symbols 181 are rearranged. In other words, the rearrangement-number determining unit 114 enables the scatter object symbol memory 105 to transmit the scatter object symbol 181 stored therein to the scatter symbol memory 106, thereby setting it as the scatter symbol 182.

Further, the game controller 100 comprises a notifying unit 116 and a notification content memory 117 connected to the notifying unit 116. The notification content memory 117 has a storage form of a scatter symbol description table in FIG. 11 and stores character data, payout-number data and description data that correspond to the scatter symbols 182. The notifying unit 116 is adapted to read out the data stored in the notification content memory 117. The notifying unit 116 reads out the data corresponding to contents of a payout determined on the basis of the scatter symbol 182 from the notification content memory 117, outputs the contents to the display control unit 102 and displays the contents in the display unit 101 as a character 201 and a description image 202 in FIG. 1, so that it notifies the contents of payout using the image. In the mean time, the notifying unit 116 may notify the contents with voice or lights using an output device such as speaker or electrical spectaculars, in addition to the notification using an image in the display unit 101.

In the mean time, each block of the game controller 100 may be structured with a hardware or software, as required.

(Operation of Game Controller 100)

In the above structure, an operation of the game controller 100 is described. When a game start signal is outputted from the game start unit 109 through an operation of a player, the symbol determining unit 104 starts a process and the game executing unit 110 starts a unit game, so that the symbols 180 are rearranged (second process). The symbol determining unit 104 randomly selects to determine a scatter object symbol 181 among the plural symbols 180 stored in the symbol memory 108 (first process). The determined scatter object symbol 181 is stored in the scatter object symbol memory 105 and is also used for a determination process in the rearrangement-number determining unit 114.

The scatter object symbol 181 stored in the scatter object symbol memory 105 is outputted to the display symbol memory 107 and then used for an image process in the display control unit 102, so that it is displayed in the display area 101*b* of the display unit 101. In other words, the game controller 100 executes the fifth process of providing the display area 101*b* to a part different from the arrangement area 101*a* for arranging the symbols 180 and displaying the scatter object symbol 181 in the display area 101*b*. Thereby, the player can easily recognize the scatter object symbol 181 since the scatter object symbol 181 is displayed in the display area 101*b* separated from the arrangement area 101*a*.

In addition, when the symbols 180 are rearranged as a unit game is executed, the rearrangement-number determining unit 114 specifies the scatter object symbol 181 among the rearranged symbols 180 and calculates a rearrangement-number of the scatter object symbol 181. Then, when the predetermined number or more of the scatter object symbols 181 are rearranged, it sets the scatter object symbol 181 as a scatter symbol 182. In other words, it transmits the scatter object symbol 181 stored in the scatter object symbol memory 105 to the scatter symbol memory 106. Thereby, the scatter object symbol 181 serves as a scatter symbol 182. In addition, when the scatter symbol 182 is set, the notifying unit 116 reads out the character data from the notification content memory 117, the payout-number data and the description data corresponding to the scatter symbol 182 and outputs the data to the display control unit 102. Then, it is notified the contents of a payout determined on the basis of the scatter symbols 182 rearranged on and out of the payline L and the payout is awarded (fourth process).

In addition, when the scatter symbol 182 is stored in the scatter symbol memory 106, the scatter symbol 182 is displayed in the display unit 101 by an information process in the display control unit 102. In other words, when the predetermined number or more of the scatter object symbols 181 are rearranged, the game controller 100 executes the sixth process of notifying that the scatter object symbol 181 is set as a scatter symbol 182. Thereby, since the display is changed from the scatter object symbol 181 to the scatter symbol 182, the player can easily recognize that a condition of the scatter symbol 182 has been fulfilled, and can enjoy that the player will be provided with a payout for the scatter symbol 182.

Then, a payout determined by a combination of the symbols 180 rearranged on the payline L is awarded by the scatter symbol payout determining unit 112 and the payout award unit 113. Thereby, the game controller 100 executes the third process of rearranging the symbols to award a payout determined by a combination of the symbols 180 rearranged on the payline L.

As can be seen from the above operation, the slot machine 10 embodies the playing method of randomly selecting to determine the scatter object symbol 181 among the plural symbols 180, rearranging the symbols 180 in the display unit 101, awarding a payout determined by a combination of the symbols 180 rearranged on the payline L, and when the predetermined number or more of the scatter object symbols 180 are rearranged, setting the scatter object symbol 181 as the scatter symbol 182 and awarding a payout determined by the scatter symbol 182.

Further, the slot machine 10 embodies the playing method of notifying that scatter object symbol 181 is set as the scatter symbol 182, and the playing method of providing the display area 101*b* to a part different from the arrangement area 101*a* for arranging the symbols 180 and displaying the scatter object symbol 181 in the display area 101*b*.

(Display State)

Figure 3:
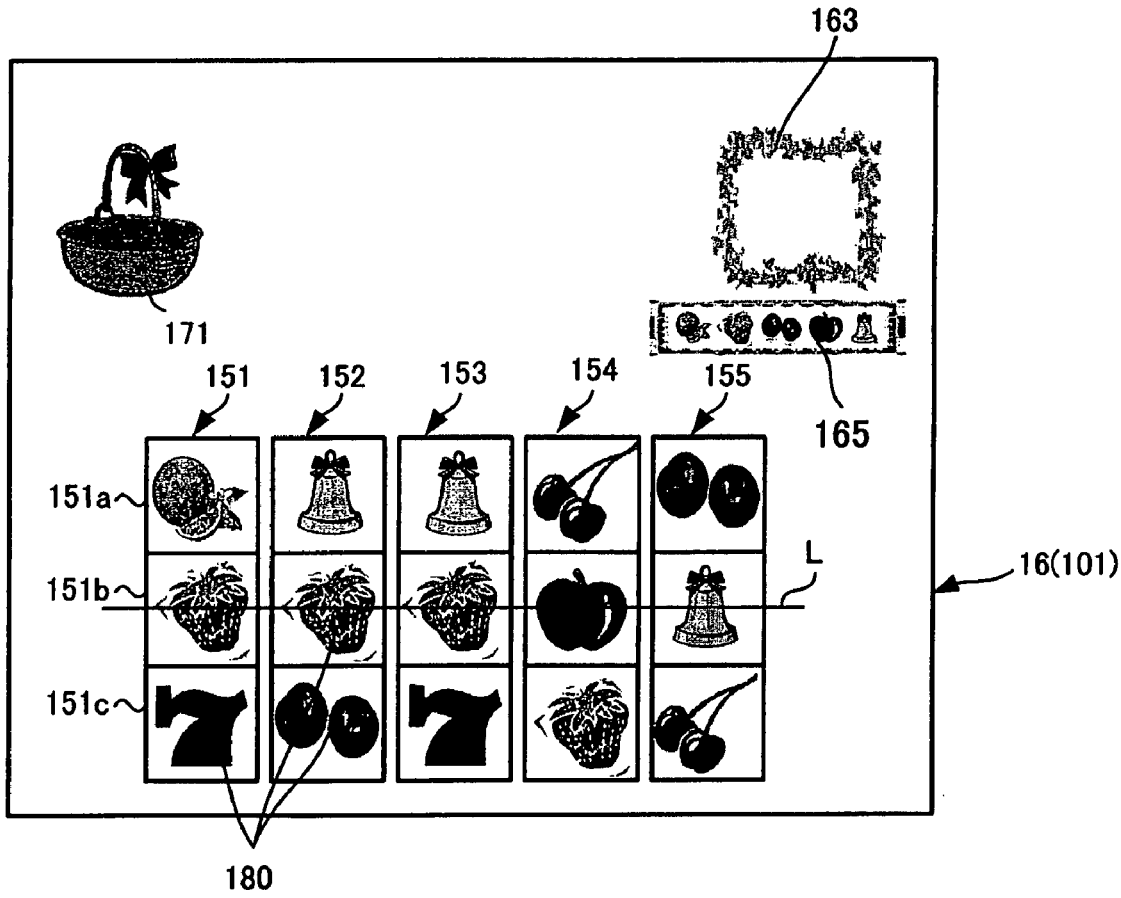
FIG. 3 illustrates a display screen.
Figure 4:
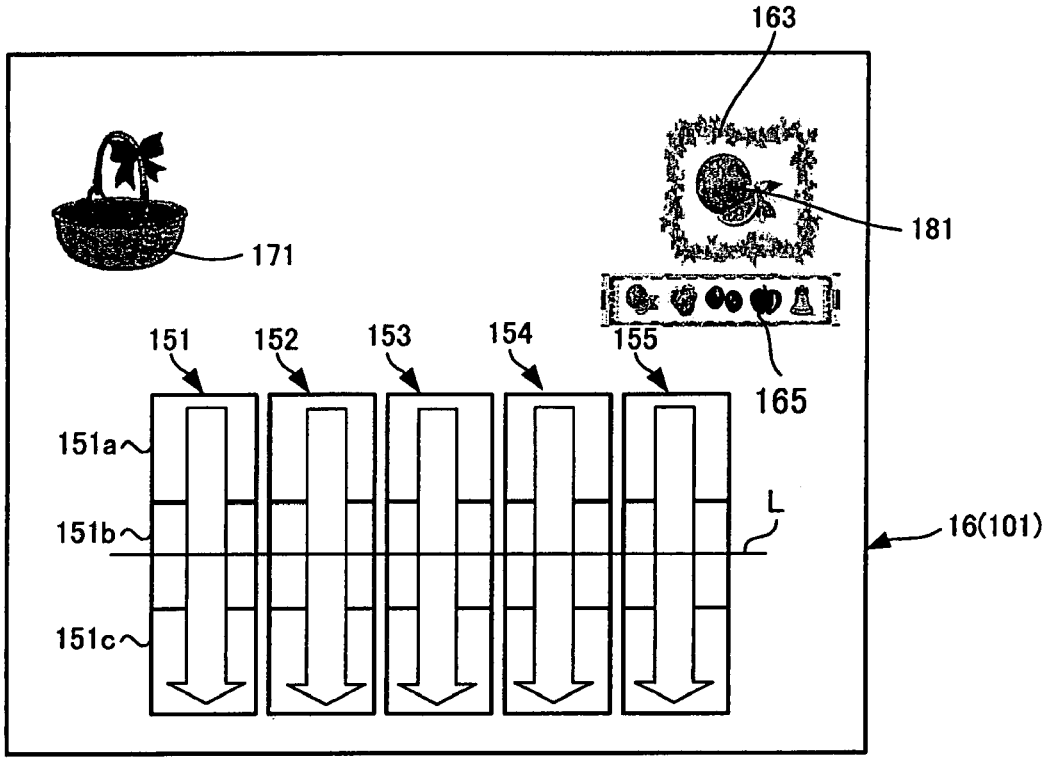
FIG. 4 illustrates a display screen.
Figure 5:
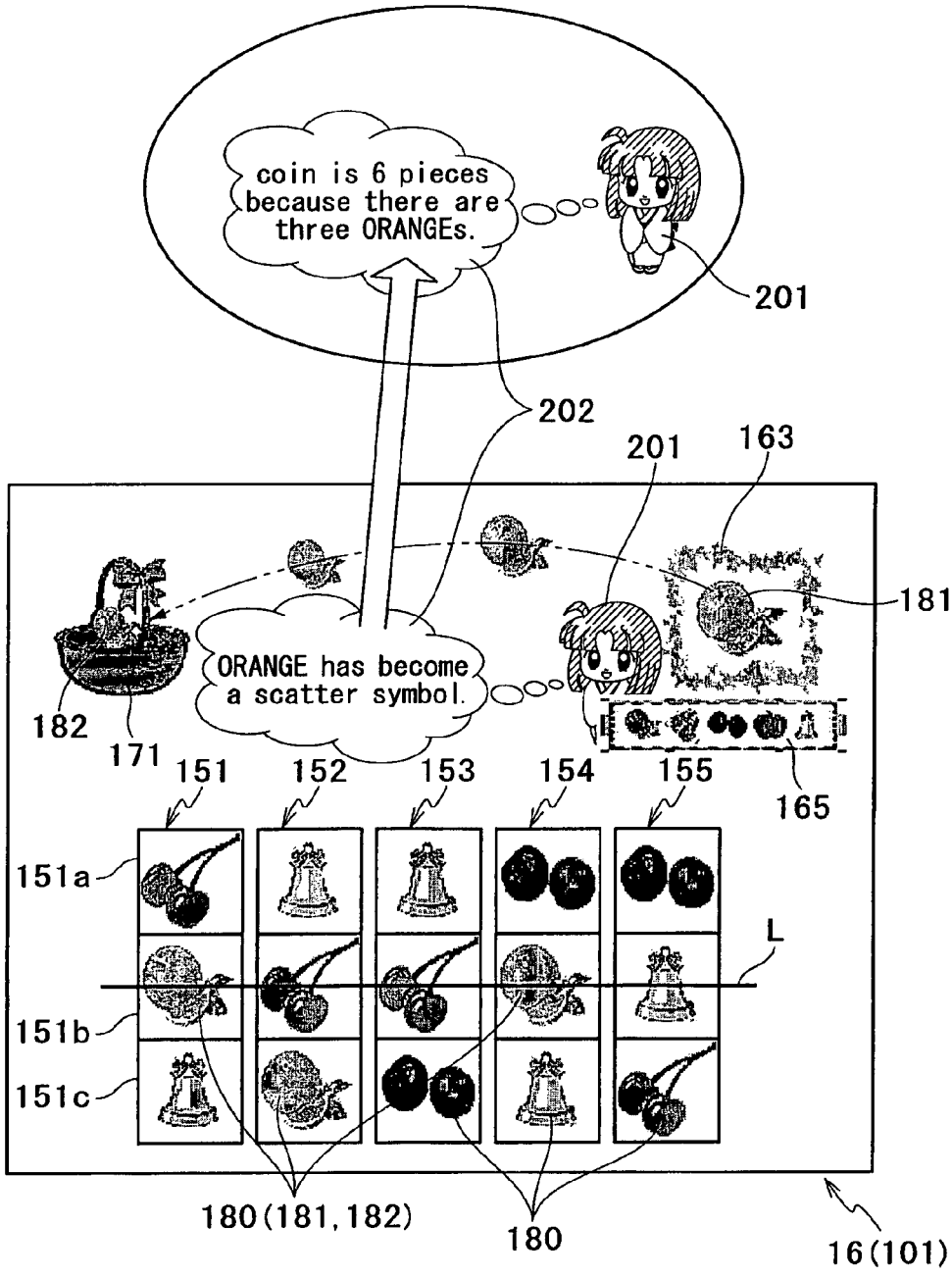
FIG. 5 illustrates a display screen.

It is specifically described an example of a display state of the display unit 101, with respect to the operation processes of the slot machine 10 and the playing method. In the mean time, as shown in FIGS. 3 to 5, the display state is described with reference to a structure in which the display unit 101 arranges the symbols with a video reel manner.

The display unit 101 has display windows 151~155 as the arrangement area for arranging the plural symbols. The display windows 151~155 are arranged in a central part of the display unit 101. In the display windows 151~155, symbol columns consisting of the plural symbols 180 are scroll-displayed. In addition, each of the display windows 151~155 is divided into upper, center and lower stages 151*a*, 151*b*, 151*c*. Each of the symbols 180 is stopped (arranged) in the respective stages 151*a*, 151*b*, 151*c*. For example, in FIG. 3, "ORANGE" is stopped in the upper stage 151*a* of the display window 151, "STRAWBERRY" is stopped in the center stage 151*b* of the display window 151 and "BLUE 7" is stopped in the lower stage 151*c* of the display window 151. As a result, the display windows 151~155 display a symbol matrix consisting of 5 columns and 3 rows. In the mean time, the symbol matrix is not limited to 5 columns/3 rows.

In addition, the display unit 150 has a scatter object symbol display unit 163 as the display area for displaying the scatter object symbols 181. The scatter object symbol display unit 163 is arranged in a right-handed upper part of the display unit 151 so as not to overlap with the display windows 151~155. In the mean time, the scatter object symbol display unit 163 may be provided to an arbitrary position on condition that it can avoid the overlapping with the display windows 151~155.

A selection object window 165 is provided to a lower part of the scatter object symbol display unit 163. The selection object window 165 displays a symbol which will be a candidate for the scatter object symbol 181. Accordingly, the player can intuitively recognize that a scatter object symbol 181 is randomly selected among the candidate symbols displayed in the selection object window 165 and then displayed in the scatter object symbol display unit 163.

In addition, the display unit 101 has a scatter symbol display unit 171. The scatter symbol display unit 171 is basket-shaped, and displays the scatter symbol 182 as a received thing, as shown in FIG. 4. The scatter symbol display unit 171 is provided to a left-handed upper corner part of the display unit 101. In the mean time, the scatter symbol display unit 171 may be provided to an arbitrary position on condition that it can avoid the overlapping with the display windows 151~155 and the scatter object symbol display unit 163.

In the display unit 101 structured as described above, the display state of FIG. 3 shows a state before starting a unit game. In other words, after the symbols 180 are rearranged in the display windows 151~155, it is made a display state shown in FIG. 3 at the time when a next game is started. A received thing is not shown in the scatter symbol display unit 171. In addition, the scatter object symbol 181 is not displayed in the scatter object symbol display unit 163, too.

Thereby, the player can intuitively recognize that the scatter object symbol 181 or scatter symbol 182 may be displayed after the game is started, by observing a state in which the received state is not displayed in the scatter symbol display unit 171 and a state in which the scatter object symbol 181 is not displayed in the scatter object symbol display unit 163, with naked eyes.

A display state of FIG. 4 shows a state just after the unit game is started. Specifically, the symbols 180 are scroll-displayed in the display windows 151~155. Then, the scatter object symbol 181 is displayed in the scatter object symbol display unit 163 during the scroll display. Thereby, the player can recognize that "ORANGE", for example may become a scatter symbol 182, by noticing that the scatter object symbol 181 is displayed in the scatter object symbol display unit 163 while the symbols 180 are scroll-displayed in the display windows 151~155.

A display state of FIG. 5 shows a state that the scatter symbol 182 has been set. Specifically, "ORNAGE" is displayed as a received thing in the scatter symbol display unit 171, through a series of operations that "ORANGE" displayed in the scatter object symbol display unit 163 is moved to the scatter symbol 182 and then received. As a result, the player can intuitively recognize that "ORANGE" has been set as the scatter symbol 182 by observing the displayed state of the scatter symbol 182 with naked eyes.

Further, in the display state of FIG. 5, a character 201 corresponding to the scatter symbol 182 is displayed and a description image 202, which represents contents of a payout determined on the basis of a payout unit corresponding to a type of the scatter symbol 182, is displayed. The description image 202 is set so that the displayed contents are changed as time goes by. Specifically, the description image 202 that is first displayed is such a letters image that "ORANGE has become a scatter symbol." In other words, the first description image 202 notifies a type of the scatter symbol 182. Thereby, the player can recognize that "ORANGE" has become a scatter symbol 182 by observing the description image 202 with naked eyes.

When a predetermined time period, for example 3 seconds have lapsed after the first description image 202 is displayed, it is changed into a next description image 202. The next description image 202 is such a letters image that "coins are 6 (six) because there are three ORANGEs." In other words, the next description image 202 notifies the contents of a payout. Thereby, the player can recognize in advance that a payout will be awarded somewhat as the result of the setting of the scatter symbol 182.

(Symbol, Combination, etc.)

As shown in FIG. 6, the symbols 180 to be displayed in the display windows 151~155 of the display unit 101 constitute columns of symbols, each of which consists of 22 symbols. The symbols constituting the respective columns of symbols are given with one code number of 0~21. Each of the columns of symbols is constituted with a combination of symbols of "JACKPOT 7," "BLUE 7," "BELL," "CHERRY," "STRAWBERRY," "PLUM," "ORANGE" and "APPLE."

The three successive symbols in the columns of symbols are displayed (arranged) in the upper, center and lower stages 151*a*, 151*b*, 151*c* of the display windows 151~155, respectively, so that they constitute a symbol matrix of 5 columns/3 rows. When a 1-BET button 26 or MAX-BET button 27 is pushed and then a spin button 23 is pushed, the symbols constituting the symbol matrix start the scroll. When the scroll starts, the scrolls of the respective symbols are stopped (rearranged) after a predetermined time period has lapsed.

In addition, various winning combinations are predetermined with regard to the respective symbols. The winning combination is a combination that a combination of symbols stopped on the payline L becomes an advantageous state to the player. The advantageous state is a state in which a coin is paid out in accordance with the winning combination, a state in which the payout-number of coins is added to a credit, a state in which a bonus game is started, and the like.

Specifically, when a combination of "APPLE" symbol is stopped on the payline L, a bonus is triggered and a gaming state is shifted to a bonus game from a basic game. In addition, when a symbol of "CHERRY" is stopped on the payline L, 20 coins (game medium) are paid out per one bet. When a symbol of "PLUM" is stopped on the payline L, 5 coins are paid out per one bet.

In the mean time, a bonus game is a gaming state that is more advantageous than a basic game. In one embodiment, the bonus game is a free game. The free game is a gaming state allowing a player to play a game for a predetermined number of times, without betting a coin. The bonus game is not particularly limited as long as it is a gaming state advantageous to the player, i.e., it is more advantageous than the basic game. For example, the bonus game may include a state in which it is possible to obtain more game medium than the basic game, a state in which it is possible to obtain a game medium in a higher probability than in the basic game, a state in which a game medium is less consumed than in the basic game, and the like. Specifically, a free game, a second game and the like are examples of the bonus game.

(Mechanical Structure)

In the followings, it will be described an example of the slot machine structured in a mechanical and electrical manner.

Figure 7:
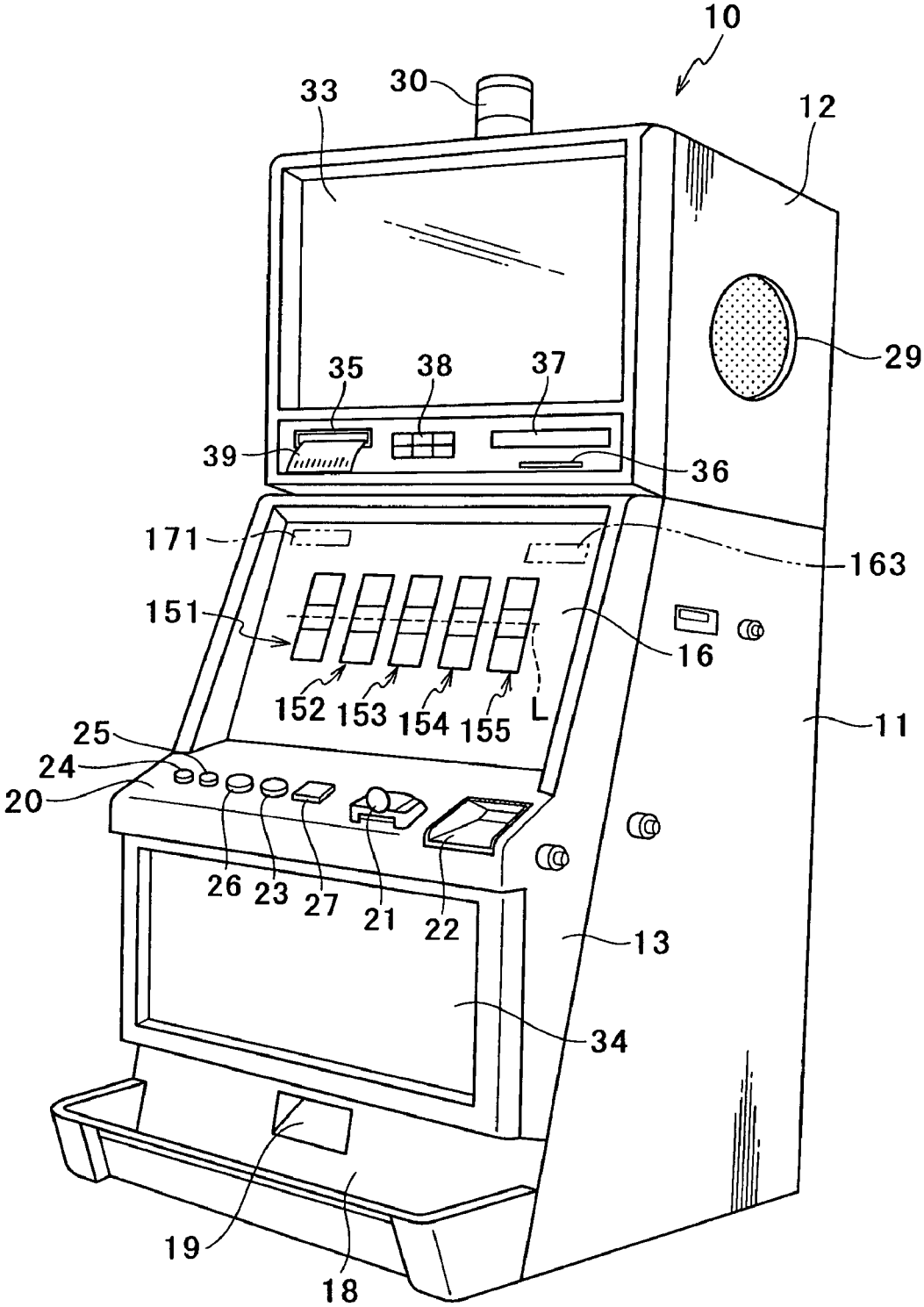
FIG. 7 is a perspective view showing an external appearance of a slot machine.

As shown in FIG. 7, the slot machine 10 is provided in a game arcade. The slot machine 10 executes a unit game by using a game medium. The game medium is a coin, bill or electronic negotiable information corresponding to them. Meanwhile, in the invention, the game medium is not particularly limited. For example, a medal, token, electronic money, ticket and the like can be used. The ticket is not particularly limited and may be a ticket with a barcode which will be described later.

The slot machine 10 comprises a cabinet 11, a top box 12 provided to an upper part of the cabinet 11 and a main door 13 provided to a front of the cabinet 11. The main door 13 is provided with a lower image display panel 16. The lower image display panel 16 has a transparent liquid crystal panel for displaying a variety of information. The lower image display panel 16 displays a video reel and a variety of information and effect images relating to a game. Specifically, the lower image display panel 16 displays the display windows 151~155 of 5 columns/3 rows, the scatter object symbol display unit 163 and the scatter symbol display unit 171, as shown in FIG. 1, and other effect images, as required.

In the mean time, in this embodiment, it is exemplified a case where the symbols of 5 columns/3 rows are displayed with the lower image display panel 16. However, the invention is not limited thereto. For example, a mechanical reel having symbols provided to a periphery thereof may be rotated and stopped to display symbols which are beyond a display window 15.

One activated payline L is displayed in the lower image display panel 16. The payline L is set to horizontally traverse the center stages 151*b* of the display windows 151~155. Meanwhile, in this embodiment, although the payline L traverses the center stages 151*b* of the display windows 151~155, it may traverse the other stages of the display windows 151~155. For example, the payline L may traverse the upper stages 151*a* or lower stages 151*c* of the display windows 151~155. Alternatively, the payline L may traverse the lower stage 151*c* of the display window 151, the center stage 151*b* of the display window 152 and the upper stage 151*a* of the display window 153. Further, the payline L may be 2 or more. When two or more paylines L are provided, all paylines L may be activated and the number of paylines L relating to a predetermined condition such as bet-number of coins may be activated.

In the mean time, a credit-number display unit and a payout-number display unit may be displayed in the lower image display panel 16. The credit-number display unit displays a total number that the slot machine 10 can pay out to a player (which will be referred to as total credit-number). The payout-number display unit displays number of coins to be paid out when a combination of symbols stopped on the payline is a winning combination.

A control panel 20, a coin receiving slot 21 and a bill validator 22 are provided below the lower image display panel 16. The control panel 20 is provided with plural buttons 23~27. The buttons 23~27 allows instructions, which are related to a game progress by a player, to be inputted. The coin receiving slot 21 enables a coin to be received in the cabinet 11.

The control panel 20 is provided with a spin button 23, a change button 24, a cash out button 25, a 1-BET button 26 and a MAX-BET 27. The spin button 23 is a button for inputting an instruction to start the scroll of symbols. The change button 24 is a button to be used when a player asks a staff in the game arcade for exchange of money. The cash out button 25 is a button for inputting an instruction to pay out the coins of total credit-number into a coin tray 18.

The 1-BET button 26 is a button for inputting an instruction to bet one coin, among coins of the total credit-number, per one game. The MAX-BET button 27 is a button for inputting an instruction to bet maximum coins (for example, 50 coins), among coins of the total credit-number, per one game.

The bill validator 22 validates whether bill is normal or not and receives the normal bill into the cabinet 11. In the mean time, the bill validator 22 can read a ticket 39 having a barcode which will be described later. When the bill validator 22 reads the ticket 39 having a barcode, it outputs a reading signal relating to the read content to a main CPU 41.

A belly glass 34 is provided to a lower frontal surface of the main door 13, i.e., below the control panel 20. A character of the slot machine 10 and the like are drawn on the belly glass 34. An upper image display panel 33 is mounted to a front of the top box 12. The upper image display panel 33 has a liquid crystal panel and displays, for example, an effect image and an image indicating an introduction of a game content and an explanation of a game rule.

To the top box 12 is mounted a speaker 29 for outputting voice. A ticket printer 35, a card reader 36, a data displayer 37 and a keypad 38 are provided below the upper image display panel 33. The ticket printer 35 prints a barcode having data encoded thereto, such as credit-number, date and time, identification number of the slot machine 10 and the like, onto a ticket, thereby outputting the ticket 39 having the barcode. The player can play a game in another slot machine with the ticket 39 having a barcode and exchange the ticket 39 having a barcode with bill in a change booth of the game arcade.

The card reader 36 reads and writes the data from and into a smart card. The smart card is a card carried by a player, into which data for identifying the player and data relating to a game history of the player are memorized.

The data displayer 37 consists of a fluorescent display and the like, and displays the data read by the card reader 36 and the data inputted by the player through the keypad 38. The keypad 38 inputs instructions or data relating to a ticket issue.

(Electrical Structure)

Figure 8:
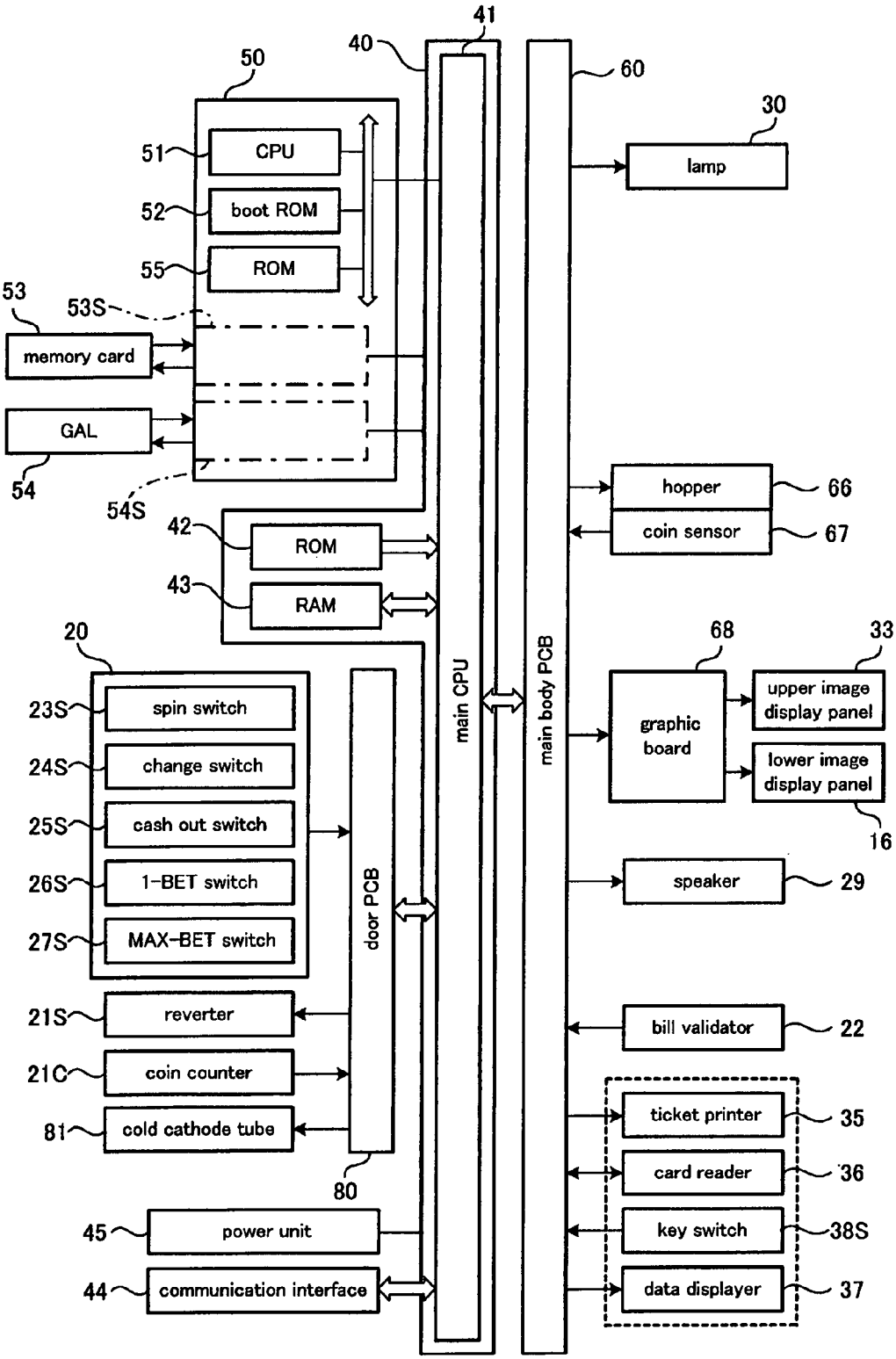
FIG. 8 is a block diagram showing a control circuit of a slot machine.

A control unit having the game controller 100 shown in FIG. 2 is mounted in the cabinet 11. As shown in FIG. 8, the control unit comprises a motherboard 40, a main body PCB (Printed Circuit Board) 60, a gaming board 50, a sub CPU, a door PCB 80, and various switches and sensors.

The gaming board 50 is provided with a CPU (Central Processing Unit) 51, a ROM 55 and a boot ROM 52 which are connected to each other by an internal bus, a card slot 53S corresponding to a memory card 53 and an IC socket 54S corresponding to a GAL (Generic Array Logic) 54.

The memory card 53 stores a game program and a game system program therein. The game program includes a stop symbol determining program. The stop symbol determining program is a program for determining a symbol (code number corresponding to the symbol) to be stopped on the payline L. The stop symbol determining program includes symbol weight data corresponding to each of plural payout rate (for example, 80%, 84%, 88%). The symbol weight data is data representing a correspondence relation between the code number of each symbol and 1 or plural random numbers belonging to a predetermined numerical range (0~256) for each of the display windows 151~155.

The payout rate is determined on the basis of data for setting a payout rate, which data is outputted from the GAL 54, and a stop symbol is determined on the basis of the symbol weight data corresponding to the payout rate.

Further, the memory card 53 stores various data used for the game program and the game system program. Specifically, the data representing a relationship between the symbols 180 displayed in the display windows 151~155 of FIG. 1 and the range of random numbers is stored in a scatter object symbol-determining table form shown in FIG. 9. The data of the data table in FIG. 9 is used to randomly select a scatter object symbol 181 among the plural symbols 180. Further, the data representing a relationship between a set threshold value and a range of random numbers is stored in a set threshold value determining table form shown in FIG. 10. The data of the data table in FIG. 10 is used when a set threshold value of whether to determine the scatter object symbol 181 as the scatter symbol 182 is randomly selected among "2"~"6." The detailed contents of the respective data tables will be described later. In addition, the data for notifying the content of a payout determined on the basis of the scatter symbol 182 is stored in a notification content table shown in FIG. 11. In the mean time, these data are transmitted to a RAM 43 of the motherboard 40 when executing the game program.

In addition, the card slot 53S is structured to insert and remove the memory card 53 and connected to the motherboard 40 through an IDE bus. Accordingly, it is possible to change a type or content of a game to be executed in the slot machine, by removing the memory card 53 from the card slot 53S, writing another game program and game system program in the memory card 53 and inserting the memory card 53 into the card slot 53S.

The game program includes a program relating to a game progress and a program for shifting a gaming state into a bonus game. In addition, the game program includes image data and voice data to be outputted during the game.

The GAL 54 is provided with plural input and output ports. When the data is inputted into the input ports, the GAL 54 outputs data corresponding to the inputted data from the output ports. The data outputted from the output ports is the data for setting a payout rate which has been described above.

The IC socket 54S is structured to attach and detach the GAL 54. The IC socket 54S is connected to the motherboard 40 through a PCI bus. Accordingly, it is possible to change the data for setting a payout rate which is outputted from the GAL 54, by detaching the GAL 54 from the IC socket 54S, rewriting the program stored in the GAL 54 and then attaching the GAL 54 to the IC socket 54S.

The CPU 51, the ROM 55 and the boot ROM 52, which are connected to each other by the internal bus, are connected to the motherboard 40 through the PCI bus. The PCI bus carries out a signal transfer between the motherboard 40 and the gaming board 50 and supplies power to the gaming board 50 from the motherboard 40. The ROM 55 stores nation identification information and an authentication program. The boot ROM 52 stores a preliminary authentication program and a program (boot code) enabling the CPU 51 to execute the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication to be authenticated is not falsified, i.e., for authenticating the authentication program.

The motherboard 40 is provided with a main CPU 41 (controller), a ROM (Read Only Memory) 42, a RAM (Random Access Memory) 43 and a communication interface 44.

The main CPU 41 has functions of a controller for controlling the whole slot machine 10. In particular, the main CPU 41 carries out a control for outputting a command signal to scroll the symbols of the lower image display panel 16 when the spin button 23 is pushed after the credit is bet, a control for determining symbols to be stopped after the symbols are scrolled and a control for stopping the determined symbols in the display windows 151~155.

In other words, the main CPU 41 has functions of an arrangement controller for selecting and determining arrangement symbols with regard to a symbol matrix from the plural types of symbols so as to rearrange them, as a new symbol matrix after scrolling the plural symbols to be displayed in the lower image display panel 16, and executing an arrangement control which will be stopped at the determined symbols from the scroll state.

In addition, the main CPU 41 has functions of the game controller 182 for executing the first process of randomly selecting to determine the scatter object symbol 181 among the plural symbols 180, the second process of rearranging the symbols 180 in the display, the third process of awarding a payout determined on the basis of a combination of the symbols 180 rearranged on the payline L and the fourth process of when the predetermined number or more of the scatter object symbols 181 are rearranged, setting the scatter object symbol 181 as the scatter symbol 182, notifying contents of a payout determined on the basis of the scatter symbol 182 and awarding the corresponding payout at the same time. Further, the main CPU 41 has a function of the game controller 100 for executing the fifth process of providing the display area (scatter object symbol display unit 163) to a part different from the arrangement area (display windows 151~155) for arranging the symbols 180 and displaying the scatter object symbol 181 in the display area and the sixth process of when the predetermined number or more of the scatter object symbols 181 are rearranged, notifying that the scatter object symbol 181 is set as the scatter symbol 182.

The ROM 42 stores a program such as BIOS (Basic Input/Output System) executed by the main CPU 41, and data that is permanently used. When the BIOS is executed by the main CPU 41, each of peripheral devices is initialized and the game program and the game system program stored in the memory card 53 are read out through the gaming board 50.

The RAM 43 stores the data or program which is used when the CPU 41 carries out a process. For example, in the RAM 43, the scatter object symbol memory 105, the scatter symbol memory 106, the symbol memory 108 and the display symbol memory 107 shown in FIG. 2 are provided in a data area form. The data area of the scatter object symbol memory 105 stores the scatter object symbols 181. The data area of the scatter symbol memory 106 stores the scatter symbol 182. The data area of the symbol memory 108 stores the symbols 180 in the data table form shown in FIG. 6. The data area of the display symbol memory 107 stores the symbols 180, the scatter object symbols 181 and the scatter symbols 182.

The communication interface 44 is provided to communicate with a host computer and the like through a communication line, which are mounted in the game arcade. In addition, the motherboard 40 is connected to the main body PCB (Printed Circuit Board) 60 and the door PCB 80 through a USB (Universal Serial Bus). Further, the motherboard 40 is connected to a power unit 45. When power is supplied to the motherboard 40 from the power unit 45, the main CPU 41 of the motherboard 40 is operated and the power is supplied to the gaming board 50 through the PCI bus, so that the CPU 51 is also operated.

The main body PCB 60 and the door PCB 80 are connected to a device or apparatus for producing an input signal which will be inputted to the main CPU 41, and a device or apparatus which is controlled by the control signal outputted from the main CPU 41. The main CPU 41 executes the game program and the game system program stored in the RAM 43, based on the input signal inputted to the main CPU 41 to carry out an arithmetic process, thereby storing a result thereof in the RAM 43 or transmitting a control signal to each device or apparatus to control it.

The main body PCB 60 is connected with a lamp 30, the sub CPU, a hopper 66, a coin sensor 67, a graphic board 68, the speaker 29, the bill validator 22, the ticket printer 35, the card reader 36, a key switch 38S and the data displayer 37.

The lamp 30 is turned on/off on the basis of the control signal outputted from the main CPU 41. The sub CPU controls the scroll of symbols of the display windows 151~155 and is connected to a VDP (Video Display Processor). The VDP reads out image data of the symbol stored in an image data ROM, produces a scroll image to be displayed in the display windows 151~155 and outputs the scroll image in the lower image display panel 16.

The hopper 66 is mounted in the cabinet 11 and pays out predetermined number of coins to the coin tray 18 from the coin payout slot 19, based on the control signal outputted from the main CPU 41. The coin sensor 67 is mounted in the coin payout slot 19 and outputs an input signal to the main CPU 41 when it detects that the predetermined number of coins are paid out from the coin payout slot 19.

The graphic board 68 controls an image display in the upper image display panel 33 and the lower image display panel 16, based on the control signal outputted from the main CPU 41. In addition, the graphic board 68 is provided with a VDP for producing image data on the basis of the control signal outputted from the main CPU 41, a video RAM for temporarily storing the image data produced by the VDP, and the like.

The bill validator 22 reads an image of the bill and accommodates the normal bill in the cabinet 11. In addition, in accommodating the normal bill, the bill validator 22 outputs an input signal to the main CPU 41, based on an amount of the bill. The main CPU 41 stores a credit-number, which corresponds to the amount of the bill transmitted by the input signal, in the RAM 43.

The ticket printer 35 prints a barcode having data encoded thereto, such as credit-number stored in the RAM 43, date and time, identification number of the slot machine 10 and the like, on a ticket, based on the control signal outputted from the main CPU 41, thereby outputting the ticket 39 having the barcode.

The card reader 36 reads the data from the smart card to transmit it to the main CPU 41, and writes the data into the smart card, based on the control signal outputted from the main CPU 41. The key switch 38S is mounted to the keypad 38, and outputs an input signal to the main CPU 41 when the player manipulates the keypad 38. The data displayer 37 displays the data which is read by the card reader 36 or the data which the player inputs through the keypad 38, based on the control signal outputted from the main CPU 41.

The door PCB 80 is connected with the control panel 20, a reverter 21S, a coin counter 21C and a cold cathode tube 81. The control panel 20 is provided with a spin switch 23S corresponding to the spin button 23, a change switch 24S corresponding to the change button 24, a cash out switch 25S corresponding to the cash out button 25, a 1-BET switch 26S corresponding to the 1-BET button 26 and a MAX-BET switch 27S corresponding to the MAX-BET button 27. Each of the switches 23S~27S outputs an input signal to the main CPU 41 when each of the corresponding buttons 23~27 is pushed by a player.

The coin counter 21C is mounted in the coin receiving slot 21 and validates whether a coin, which is inserted in the coin receiving slot 21 by the player, is normal or not. A coin except the normal coin is discharged from the coin payout slot 19. In addition, the coin counter 21C outputs an input signal to the main CPU 41 when it detects a normal coin.

The coin counter 21C is operated on the basis of the control signal outputted from the main CPU 41 and distributes a coin, which is recognized as a normal coin by the coin counter 21C, to a cash box (not shown) or hopper 66 mounted in the slot machine 10. In other words, when the hopper 66 is fully filled with the coins, the normal coin is distributed into the cash box by the reverter 21S. In the mean time, when the hopper 66 is not fully filled with the coins, the normal coin is distributed into the hopper 66. The cold cathode tube 81 functions as a backlight mounted to rear sides of the lower image display panel 16 and the upper image display panel 33 and is turned on, based on the control signal outputted from the main CPU 41.

(Data Table)

In the followings, it will be described a scatter object symbol-determining table in FIG. 9. The table has a column of symbols and a column of ranges of random numbers. The column of symbols stores 5 types of symbols consisting of "BELL," "CHERRY," "ORANGE," "STRAWBERRY" and "PLUM." The column of ranges of random numbers stores 5 types of range data consisting of "0~50," "51~100," "101~150," "151~200" and "201~250." With respect to each column, the column of symbols and the column of ranges of random numbers correspond to each other. Thereby, the scatter object symbol-determining table enables a random number value to be randomly selected within a range of "0~255" and a symbol to be randomly selected through a relationship between the selected random number value and the range data. Specifically, when "120" is selected as a random number value, "STRAWBERRY" corresponding to "101~200" is selected.

In the followings, it will be described a set threshold value determining table in FIG. 10. The table has a column of set threshold values and a column of ranges of random numbers. The column of set threshold values stores 5 types of set threshold values consisting of "2," "3," "4," "5" and "6". The column of ranges of random numbers stores 5 types of range data consisting of "0~50," "51~100," "101~150," "151~200" and "201~250." With respect to each column, the column of symbols and the column of ranges of random numbers correspond to each other. Thereby, the set threshold value determining table enables a random number value to be randomly selected within a range of "0~255" and a set threshold value to be randomly selected through a relationship between the selected random number value and the range data. Specifically, when "72" is selected as a random number value, "3" corresponding to "51~100" is selected.

It is described a notification content table in FIG. 11. The table has a column of symbols, a column of characters, a column of payout-numbers, a first description column and a second description column. The column of symbols stores 5 types of symbols consisting of "BELL," "CHERRY," "ORANGE," "STRAWBERRY" and "PLUM." The column of characters stores type data of characters. Specifically, when the type data is "1," the data representing a woman character 201 in FIG. 1 is selected.

The column of payout-numbers stores data representing a payout number per symbol. Specifically, the data, for example 1 coin for "BELL," 5 coins for "CHERRY," 2 coins for "ORNAGE" and the like are stored. The first description column stores data which is displayed as a first description image 202. Specifically, the image data representing that ""symbol" has become a scatter symbol" is stored. The "symbol" in the image data is inserted with a symbol name such as ORNAGE which has become the scatter symbol 182.

In addition, the second description column stores data which is displayed as a next description image 202. Specifically, the image data is stored which "coin is "-" pieces since there are the "symbols" of the "rearrangement number." The "symbol" in the image data is inserted with a symbol name such as ORANGE which has become the scatter symbol 182. The "rearrangement number" is inserted with the number of the scatter symbol 182. "-" is inserted with the number of coins which will be paid out.

(Processing Operation)

Figure 12:
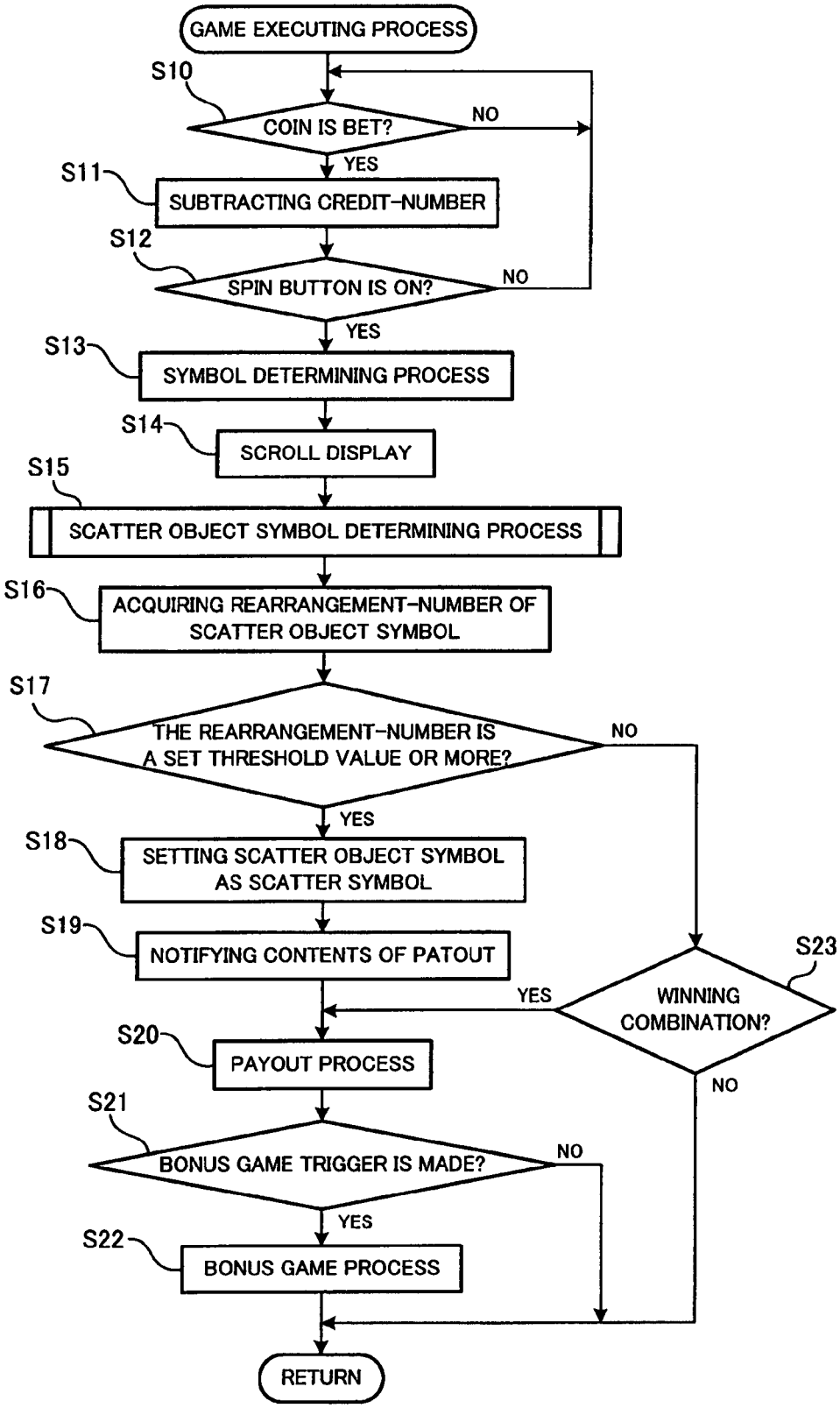
FIG. 12 is a flow chart of a game execution process.

In the followings, it will be described a process which is carried out in the slot machine 10. When the main CPU 41 reads out and executes the game program, a game is started. As shown in FIG. 12, in the game executing process, it is determined whether a coin is bet (S10). In this process, it is determined whether it is received an input signal from the 1-BET switch 26S as the 1-BET button 26 is pushed and whether it is received an input signal from the MAX-BET switch 27S as the MAX-BET button 27 is pushed. When the coin is not bet (S10, NO), the step of S10 is re-executed and it is under standby state until a coin is bet.

In the mean time, when the coin is bet (S10, YES), the credit-number stored in the RAM 43 is subtracted, correspondingly to the number of coins bet (S11). Meanwhile, if the number of coins bet is larger than the credit-number stored in the RAM 43, it is not carried out the process of subtracting the credit-number and the step of S11 is re-executed. In addition, if the number of coins bet is above the upper limit (50 pieces in this embodiment) which can be bet per one game, it is not carried out the process of subtracting the credit-number and a step of S12 is carried out.

Next, it is determined whether the spin button 23 is ON or not (S12). When the spin button 23 is not ON (S12, NO), the process is returned to the step of S10. In the mean time, when the spin button 23 is not ON (for example, when the spin button 23 is not ON and an instruction to end the game is inputted), it is canceled the subtraction result in the step of S11. Meanwhile, the lower image display panel 16 is under display state of FIG. 3.

In the mean time, when the spin button 23 is ON (S12, YES), a symbol determining process is executed (S13). In other words, a stop symbol determining program stored in the RAM 43 is executed, so that it is determined the symbols 180 which will be stopped in the fifteen respective stages of the display windows 151~155. Thereby, it is determined a combination of symbols to be stopped on the payline L.

Next, as shown in FIG. 4, the symbols 180 of the display windows 151~155 are scroll-displayed (S14). In the mean time, the scroll process is such that the symbols 180 are scrolled in an arrow direction and then the symbols 180 determined in the step of S13 are stopped (rearranged) in the display windows 151~155.

Figure 13:
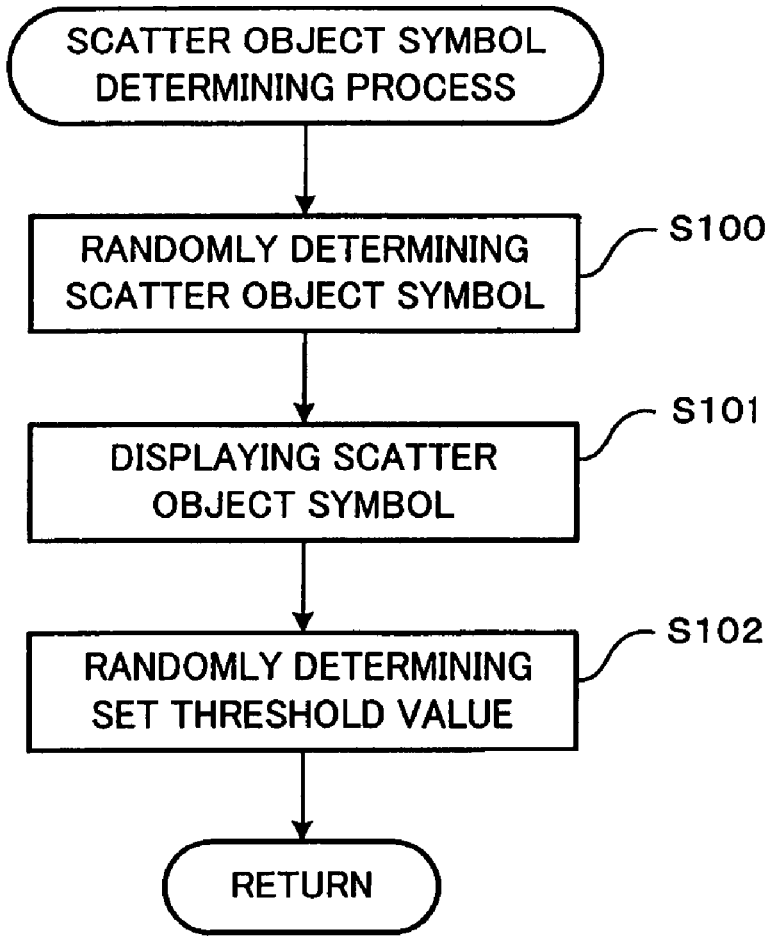
FIG. 13 is a flow chart of a scatter object symbol-determining process.

Then, a scatter object symbol-determining process is executed (S15). Specifically, it is executed a scatter object symbol-determining process routine in FIG. 13. More specifically, it is referred to the scatter object symbol-determining table in FIG. 9. Then, a scatter object symbol 181 is randomly determined among the symbols 180 of "BELL," "CHERRY," "STRAWBERRY," "PLUM," "ORNAGE" and "APPLE." Then, as shown in FIG. 4, the determined scatter object symbol 181 is displayed in the scatter object symbol display unit 163 (S101). After that, it is referred to the set threshold value-determining table of FIG. 10 and a set threshold value is randomly selected (S102).

Thereby, the player can intuitively recognize a symbol which can be a scatter symbol 182, by observing a state in which the received thing is not displayed in the scatter symbol display unit 171 and a state in which the scatter object symbol 181 is displayed in the scatter object symbol display unit 163, with naked eyes.

Next, the process is returned to a game executing process routine in FIG. 12. Then, as shown in FIG. 5, when the scroll of the symbols 180 is stopped, it is acquired a rearrangement-number of the scatter object symbols 181 (S16). After that, it is determined whether the rearrangement-number is the set threshold value or more (S17). When the number is the set threshold value or more (S17, YES), the scatter object symbol 181 is set as the scatter symbol 182. Specifically, the scatter object symbol 181 is moved to the scatter symbol display unit 171 from the scatter object symbol display unit 163 and then received in the scatter symbol display unit 171. Then, the symbol is displayed with being received in the scatter symbol display unit 171 as a received thing (S18).

After that, a character 201 is displayed between the scatter symbol display unit 171 and the scatter object symbol display unit 163 and a speech bubble representing speech contents of the character 201 is displayed. Then, a first description image 202 of "ORNAGE has become a scatter symbol." is displayed. After that, after a predetermined time period of 3 seconds, for example has lapsed, the image is changed into a next description image 202 of "the coin is 6 pieces because there are three ORANGEs." Thereby, the player knows that "ORNAGE" has been set as the scatter symbol 182 and also knows the specific contents of a payout resulting from that "ORANGE" has become sec as the scatter symbol 182.

After that, a payout process is executed. In other words, it is summed a payout-number of the coins resulting from a winning combination and a payout-number of the coins resulting from the display-number of the scatter symbol 182. Then, in case of depositing the coins to be paid, a predetermined number of credits is added to the credit-number stored in the RAM 43. In the mean time, in case of paying out the coins, a control signal is transmitted to the hopper 66, so that a predetermined number of the coins are paid out.

In the mean time, in the display state of FIG. 5, it is not made a winning combination. In addition, since "BELL" is set as the scatter symbol 182, three scatter symbols 182 ("BELL") are displayed in the display windows 151~155. As a result, the coins corresponding to the 3 scatter symbols 182 ("BELL") are paid out (S20).

In the mean time, when the rearrangement-number is less than the set threshold value (S17, NO), it is determined whether the combination of the symbols 180 stopped on the payline L is a winning combination or not (S23). When the combination is not a winning combination (S23, NO), it means a losing because it is not made either the scatter symbol 180 or the winning combination. As a result, this routine is ended.

In the mean time, when the combination is a winning combination (S23, YES), the step of S20 is executed. After that, it is determined whether it is made a bonus trigger as a winning combination. In other words, it is determined whether a combination of "APPLE" is arranged on the payline L (S21). When it is determined that the bonus trigger is made (S21, YES), it is executed a bonus game process (S22).

In the mean time, when the bonus trigger is not made (S21, NO), it means a losing. As a result, this routine is ended.

Embodiment 2

It will be described an embodiment 2 of the slot machine 19 and the playing method thereof, according to the invention. In the mean time, the same members as the embodiment 1 are referred to with the same reference numerals and descriptions thereof are thus omitted.

Figure 14:
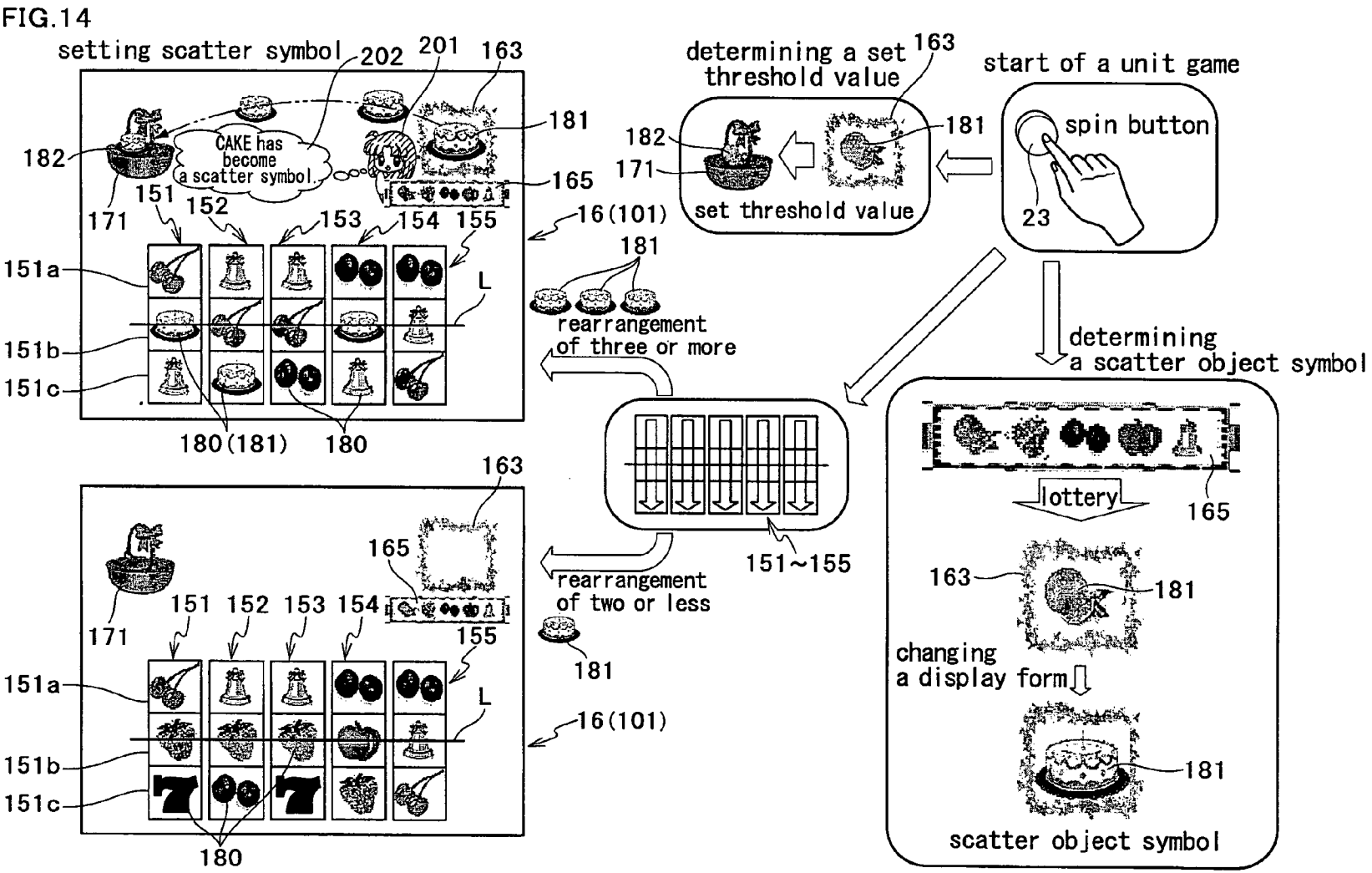
FIG. 14 illustrates a playing method of a slot machine.

As shown in FIG. 14, the slot machine carries out a playing method comprising steps of: changing the display form of the scatter object symbol 181 from after the scatter object symbol 181 is determined until it is rearranged, in addition to the steps of the playing method in the embodiment 1. In the mean time, FIG. 14 shows a state that "BELL" is selected as a scatter object symbol 181 among the five symbols 180 and then the display form of "BELL" is changed into a display form of "CAKE." The other structures are same as in the embodiment 1.

Figure 15:
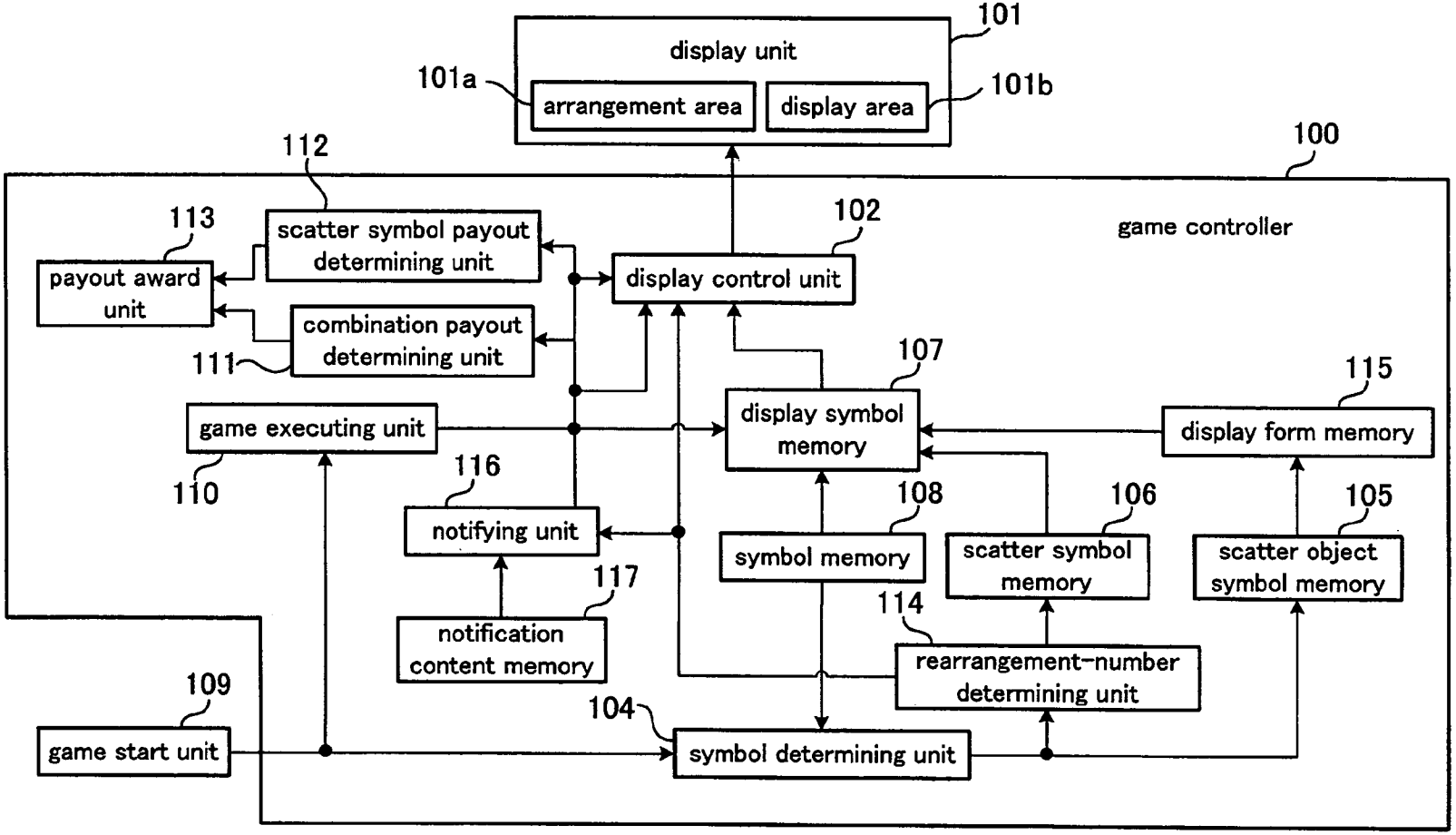
FIG. 15 is a block diagram of a slot machine.

The slot machine 10 of the invention has a display unit (display) 101 and a game controller 100, as shown in FIG. 15. The display unit 101 has a payline L and is structured to arrange plural symbols including a scatter symbol.

The game controller 100 is structured to execute a seventh process of changing the display form of the scatter object symbol 181 from after the scatter object symbol 181 is determined until it is rearranged, in addition to the first to sixth processes of the embodiment 1. In other words, the game controller 100 has plural types of scatter object symbols and first, second, third, fourth, fifth, sixth and seventh processing units. Specifically, the game controller has a display form memory 115 storing data for changing the display form of the scatter object symbol 181. The other structures are same as in the embodiment 1. Thereby, the slot machine 10 embodies a playing method of changing the display from of the scatter object symbol 181 from after the scatter object symbol 181 is determined until it is rearranged. As a result, when a scatter object symbol 181 is randomly determined, the display form of the scatter object symbol 181 is changed, so that the player can more easily recognize that the scatter object symbol 181 has been set.

Figure 16:
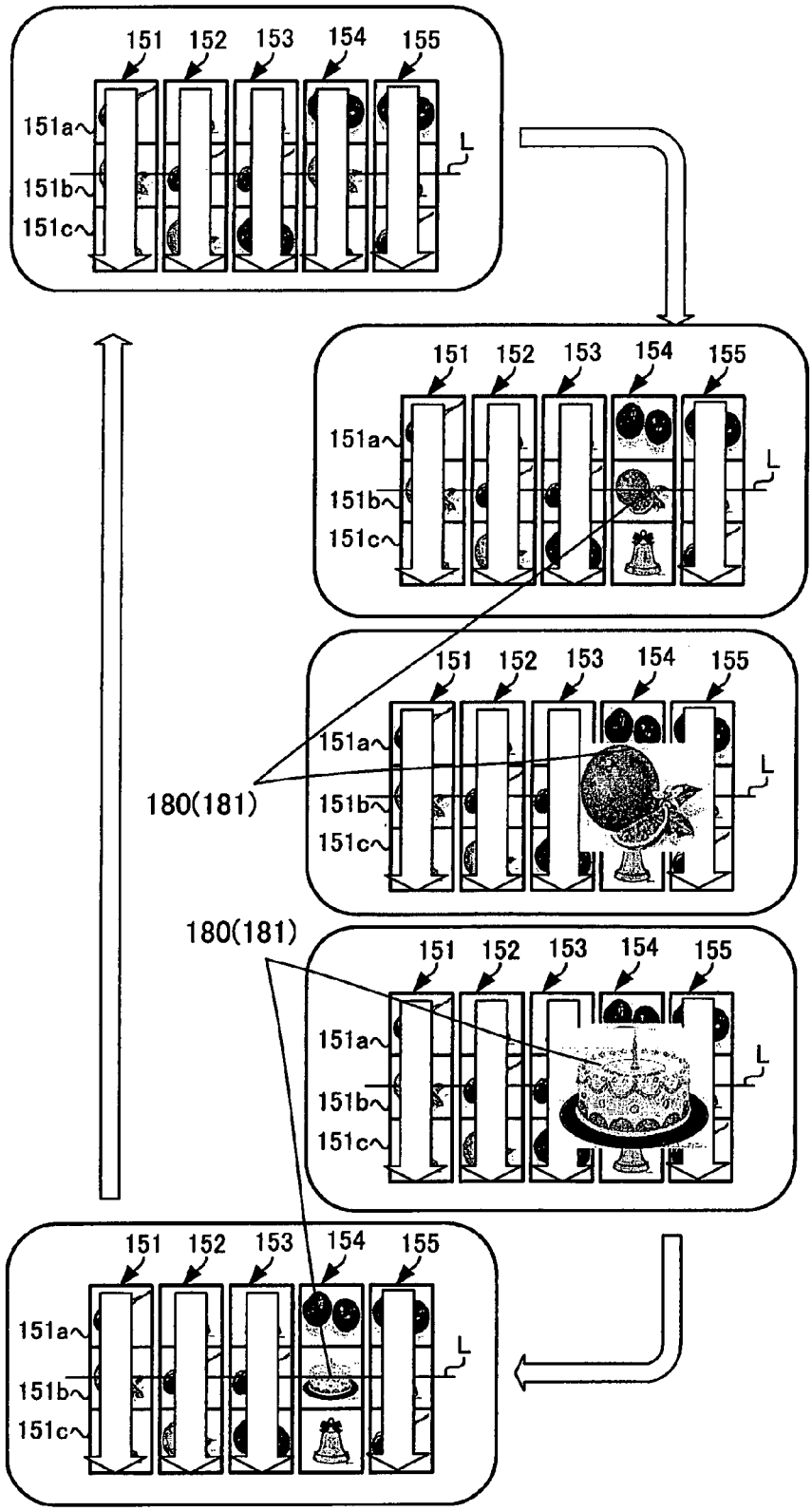
FIG. 16 illustrates a playing method of a slot machine.

In the mean time, in the embodiment 2, the display form of the scatter object symbol 181 is changed in the scatter object symbol display unit 163. However, the invention is not limited thereto. In other words, as shown in FIG. 16, a part or all of the symbols 180 may be scroll-stopped and a display form of the scatter object symbol 181 may be changed while its size is being enlarged.

In addition, although the above descriptions have been provided with regard to the characteristic parts so as to understand the invention more easily, the invention is not limited to the embodiments as described above and can be applied to the other embodiments and the applicable scope should be construed as broadly as possible. Furthermore, the terms and phraseology used in the specification have been used to correctly illustrate the invention, not to limit it. In addition, it will be understood by those skilled in the art that the other structures, systems, methods and the like included in the spirit of the invention can be derived from the spirit of the invention described in the specification. Accordingly, it should be considered that the invention covers equivalent structures thereof without departing from the spirit and scope of the invention as defined in the following claims. Further, the abstract is provided so that an intellectual property office and a general public institution or one skilled in the art who is not familiar with patent and legal or professional terminology can quickly analyze the technical features and essences of the invention through a simple investigation. Accordingly, the abstract is not intended to limit the scope of the invention that should be evaluated by the claims. In addition, it is required to sufficiently refer to the documents that have been already disclosed, so as to fully understand the objects and effects of the invention.

The above descriptions include a process that is executed on a computer or computer network. The above descriptions and expressions have been provided so that the one skilled in the art can understand the invention most effectively. In the specification, the respective steps used to induce one result or blocks having a predetermined processing function should be understood as a process having no self-contradiction. In addition, the electrical or magnetic signal is transmitted/received and written in the respective steps or blocks. Although the processes in the respective steps or blocks embody the signal as a bit, value, symbol character, term, number and the like, it should be noted that these have been used for the convenience of descriptions. Further, although the processes in the respective steps or blocks have been often described as an expression common to a human action, the process described in the specification is executed by a variety of devices in principle. In addition, the other structures necessary for the respective steps or blocks are apparent from the above descriptions.

What is claimed is:

1. A slot machine comprising:

a display having a payline and arranging plural types of symbols, and a game controller:

randomly determining a scatter object symbol from among the plural types of symbols, randomly determining a number of symbols for awarding a second payout by scatter symbols based on the determined scatter object symbol, rearranging the symbols on the display, awarding a first payout based on a combination of the symbols rearranged on the payline on the display, and when a number of the scatter object symbols are rearranged on the display is larger than the randomly determined number, setting the scatter object symbol as a scatter symbol, displaying on the display the scatter symbol thus set and awarding the corresponding second payout.

2. A slot machine comprising:

a display having a payline and arranging plural types of plural symbols, and a game controller randomly selecting to determine a scatter object symbol among the plural types of symbols, randomly determining a number of symbols for awarding a second payout by scatter symbols, based on the determined scatter object symbol, rearranging the symbols on the display, awarding a first payout determined by a combination of the symbols rearranged on the payline on the display, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol, and awarding the second payout.

3. A slot machine comprising:

a display having a payline and arranging plural types of plural symbols, and a game controller randomly selecting to determine a scatter object symbol among the plural types of symbols, providing a display area to a part different from an arrangement area for arranging the symbols and displaying the scatter object symbol in the display area, randomly determining a number of symbols for awarding a second payout by scatter symbols, based on the determined scatter object symbol, rearranging the symbols on the display, awarding a first payout determined by a combination of the symbols rearranged on the payline on the display, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol, and awarding the second payout.

4. A slot machine comprising:

a display having a payline and arranging plural types of plural symbols, and a game controller randomly selecting to determine a scatter object symbol among the plural types of symbols, randomly determining a number of symbols for awarding a second payout by scatter symbols, based on the determined scatter object symbol, rearranging the symbols on the display, awarding a first payout determined by a combination of the symbols rearranged on the payline on the display, changing a display form of the scatter object symbol from after the scatter object symbol is determined until it is rearranged, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol, and awarding the second payout.

5. A slot machine comprising:

a display having a payline and arranging plural types of plural symbols, and a game controller randomly selecting to determine a scatter object symbol among the plural types of symbols, providing a display area to a part different from an arrangement area for arranging the symbols and displaying the scatter object symbol in the display area, randomly determining a number of symbols for awarding a second payout by scatter symbols, based on the determined scatter object symbol, rearranging the symbols on the display, awarding a first payout determined by a combination of the symbols rearranged on the payline on the display, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol and awarding the second payout.

6. A slot machine comprising:

a display having a payline and arranging plural types of plural symbols, and a game controller randomly selecting to determine a scatter object symbol among the plural types of symbols, randomly determining a number of symbols for awarding a second payout by scatter symbols, based on the determined scatter object symbol, rearranging the symbols on the display, awarding a first payout determined by a combination of the symbols rearranged on the payline on the display, and changing a display form of the scatter object symbol from after the scatter object symbol is determined until it is rearranged, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol and awarding the second payout.

7. A slot machine comprising:

a display having a payline and arranging plural types of plural symbols, and a game controller randomly selecting to determine a scatter object symbol among the plural types of symbols, providing a display area to a part different from an arrangement area for arranging the symbols and displaying the scatter object symbol in the display area, randomly determining a number of symbols for awarding a second payout by scatter symbols, based on the determined scatter object symbol, rearranging the symbols on the display, awarding a first payout determined by a combination of the symbols rearranged on the payline on the display, changing a display form of the scatter object symbol from after the scatter object symbol is determined until it is rearranged, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol, and awarding the second payout.

8. A playing method of a slot machine having structures below:

randomly selecting to determine a scatter object symbol among plural types of plural symbols, randomly determining a number of symbols for awarding a second payout by scatter symbols, based on the determined scatter object symbol, rearranging the symbols on the display which has a payline and on which the plural types of the symbols are rearranged, awarding a first payout determined by a combination of the symbols rearranged on the payline on the display, and when a number of the scatter object symbols rearranged on the display is larger than the randomly determined number, setting the scatter object symbol as a scatter symbol, displaying on the display the scatter symbol thus set and contents of a payout determined on the basis of the scatter symbol, and awarding the second payout.

9. A playing method of a slot machine having structures below:

randomly selecting to determine a scatter object symbol among plural types of plural symbols, randomly determining a number of symbols for awarding a second payout by scatter symbols, based on the determined scatter object symbol, rearranging the symbols on the display which has a payline and on which the plural types of the symbols, based on the determined scatter object symbol, awarding a first payout determined by a combination of the symbols rearranged on the payline on the display; and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol, and awarding the second payout.

10. A playing method of a slot machine having structures below:

randomly selecting to determine a scatter object symbol among plural types of plural symbols, providing a display area to a part different from an arrangement area for arranging the symbols and displaying the scatter object symbol in the display area, randomly determining a number of symbols for awarding a second payout by scatter symbols, based on the determined scatter object symbol, rearranging the symbols on the display which has a payline and on which the plural types of the symbols are rearranged, awarding a first payout determined by a combination of the symbols rearranged on a payline on the display and, when a number of the scatter object symbols rearranged on the display is larger than the randomly determined number, setting the scatter object symbol as a scatter symbol, displaying on the display the scatter symbol thus set and contents of a payout determined on the basis of the scatter symbol, and awarding the second payout.

11. A playing method of a slot machine having structures below:

randomly selecting to determine a scatter object symbol among plural types of plural symbols, randomly determining a number of symbols for awarding a second payout by scatter symbols, based on the determined scatter object symbol, rearranging the symbols on the display which has a payline and on which the plural types of the symbols are rearranged, awarding a first payout determined by a combination of the symbols rearranged on the payline on the display, changing a display form of the scatter object symbol from after the scatter object symbol is determined until it is rearranged, and when a number of a predetermined number of the scatter object symbols rearranged on the display is larger than the randomly determined number of the symbols, setting the scatter object symbol as a scatter symbol, displaying on the display the scatter symbol thus set and contents of a payout determined on the basis of a payout unit corresponding to a type of the scatter symbol, and awarding the second payout.

12. A playing method of a slot machine having structures below:

randomly selecting to determine a scatter object symbol among plural types of plural symbols, providing a display area to a part different from an arrangement area for arranging the symbols and displaying the scatter object symbol in the display area, randomly determining a number of symbols for awarding a second payout by scatter symbols, based on the determined scatter object symbol, rearranging the symbols on the display which has a payline and on which the plural types of the symbols are rearranged, awarding a first payout determined by a combination of the symbols rearranged on the payline on the display, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol, and awarding the second payout.

13. A playing method of a slot machine comprising:

randomly selecting to determine a scatter object symbol among plural types of plural symbols, randomly determining a number of symbols for awarding a second payout by scatter symbols, based on the determined scatter object symbol, rearranging the symbols on the display which has a payline and on which the plural types of the symbols are rearranged, awarding a first payout determined by a combination of the symbols rearranged on the payline on the display, changing a display form of the scatter object symbol from after the scatter object symbol is determined until it is rearranged, and when a number of the scatter object symbols rearranged on the display is larger than the randomly determined number, setting the scatter object symbol as a scatter symbol, displaying on the display the scatter symbol thus set and contents of a payout determined on the basis of a payout unit corresponding to a type of the scatter symbol and awarding the second payout.

14. A playing method of a slot machine having structures below:

randomly selecting to determine a scatter object symbol among plural types of plural symbols, providing a display area to a part different from an arrangement area for arranging the symbols and displaying the scatter object symbol in the display area, randomly determining the number of symbols for awarding a second payout by scatter symbols, based on the determined scatter object symbol, rearranging the symbols, on the display which has a payline and on which the plural types of the symbols are rearranged, awarding a first payout determined by a combination of the symbols rearranged on the payline on the display, changing a display form of the scatter object symbol from after the scatter object symbol is determined until it is rearranged, and when a number of the scatter object symbols rearranged on the display is larger than the randomly determined number of the symbols, setting the scatter object symbol as a scatter symbol, displaying on the display the scatter symbol thus set and contents of a payout determined on the basis of a payout unit corresponding to a type of the scatter symbol and awarding the second payout.

15. A slot machine comprising:

a display having a payline and arranging plural types of symbols, and a game controller, the game controller:

randomly determining a scatter object symbol from among the plural types of symbols, randomly determining a number of symbols for awarding a second payout by scatter symbols based on the determined scatter object symbol, rearranging the symbols on the display, when a number of the scatter object symbols rearranged on the display is larger than the randomly determined number, setting the scatter object symbol as a scatter symbol, displaying on the display the scatter symbol thus set and awarding the second payout.

* * * * *